US009089038B2

(12) United States Patent
Camara et al.

(10) Patent No.: US 9,089,038 B2
(45) Date of Patent: Jul. 21, 2015

(54) APPARATUS AND METHOD TO GENERATE X-RAYS BY CONTACT ELECTRIFICATION

(75) Inventors: Carlos Camara, Venice, CA (US); Seth J. Putterman, Malibu, CA (US); Jonathan Hird, Ottawa (CA)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 0 days.

(21) Appl. No.: 14/113,782

(22) PCT Filed: May 3, 2012

(86) PCT No.: PCT/US2012/036310

§ 371 (c)(1), (2), (4) Date: Oct. 24, 2013

(87) PCT Pub. No.: WO2012/154494

PCT Pub. Date: Nov. 15, 2012

(65) Prior Publication Data

US 2014/0044235 A1 Feb. 13, 2014

Related U.S. Application Data

(60) Provisional application No. 61/482,031, filed on May 3, 2011.

(51) Int. Cl.
*H01J 35/00* (2006.01)
*H05G 2/00* (2006.01)

(52) U.S. Cl.
CPC ..... *H05G 2/00* (2013.01)

(58) Field of Classification Search
CPC ..... H01J 35/06
USPC ..... 378/119, 123, 136, 144
See application file for complete search history.

(56) References Cited

U.S. PATENT DOCUMENTS 4,789,802 A 12/1988 Miyake
4,990,813 A 2/1991 Paramo (Continued)

FOREIGN PATENT DOCUMENTS

SU 1149331 A1 4/1985
WO WO-2009-102784 A1 8/2009

OTHER PUBLICATIONS

Deryagin et al., "Appearance of penetrating radiation during destruction of an adhesion contact," Soviet Physics, vol. 19, No. 4, 1974, pp. 208-209.

(Continued)

*Primary Examiner* — Hoon Song
(74) *Attorney, Agent, or Firm* — Venable, LLP; Henry J. Daley; Laura G. Remus

(57) ABSTRACT

An x-ray source includes an enclosing vessel, a first roller arranged at least partially within the enclosing vessel, a second roller arranged at least partially within the enclosing vessel and to be in rolling contact with the first roller, and a drive assembly operatively connected to at least one of the first and second rollers. The drive assembly causes the first and second rollers to rotate while in contact to bring portions of the first and second rollers into and out of contact within the enclosing vessel as the first and second rollers rotate. The first roller has a surface at least partially of a first triboelectric material and the second roller has a surface at least partially of a second triboelectric material, the first triboelectric material having a negative triboelectric potential relative to the second triboelectric material. The enclosing vessel is structured to provide a controlled atmospheric environment, and the first triboelectric material, the second triboelectric material and the controlled atmospheric environment are selected such that rolling contact between the first and second rollers produces x-rays.

28 Claims, 15 Drawing Sheets

(56) References Cited

U.S. PATENT DOCUMENTS

| | | | | |
|---|---|---|---|---|
| 2003/0128805 | A1 | 7/2003 | Shepard et al. | |
| 2011/0130613 | A1* | 6/2011 | Putterman et al. | 600/1 |
| 2014/0270084 | A1* | 9/2014 | Camara | 378/123 |

OTHER PUBLICATIONS

International Search Report and Written Opinion of PCT/US2012/036310.
Apodaca, P. J. Wesson, K. J. M. Bishop, M. A. Ratner and B. A. Grzybowski, Angew. Chem. Int. Ed. 49, 946 (2010).
Budakian, K. Weninger, R. A. Hiller and S. P. Putterman, Nature 391, 266 (1998).
Camara, J. V. Escobar, J. R. Hird and S. P. Putterman, Appl. Phys. B 99, 613 (2010)).
Camara, J. V. Escobar, J. R. Hird and S. P. Putterman, Nature 455, 1089 (2008).
Constable, J. Horvat and R. A. Lewis, Appl. Phys. Lett. 97, 131502 (2010).
Karasev, N. A. Krotova and B. W. Deryagin, Dokl. Akad. Nauk. SSR 88 777 (1953).
McCathy and G. M. Whitesides, Angew. Chem. Int. Ed. 47, 2188 (2008).
McEwan and G. I. Taylor, J. Fluid Mech. 26, 1 (1966).
Shaw, Proc. R. Soc. Lond. A 94, 16 (1917).
Stoneham, Modelling Simul. Mater. Sci. Eng. 17, 084009 (2009).

* cited by examiner

APPARATUS AND METHOD TO GENERATE X-RAYS BY CONTACT ELECTRIFICATION

CROSS-REFERENCE OF RELATED APPLICATION

This is a national stage application under 35 U.S.C. §371 of PCT/US2012/036310 filed May 3, 2012, the entire contents of which are incorporated herein by reference and this application claims priority to U.S. Provisional Application No. 61/482,031 filed May 3, 2011, the entire contents of which are hereby incorporated by reference.

This invention was made with Government support under W81XWH-10-1-1049, awarded by the United States Army Medical Research and Materiel Command. The Government has certain rights in the invention.

BACKGROUND

1. Field of Invention

The field of the currently claimed embodiments of this invention relates to triboelectric x-ray sources and systems.

2. Discussion of Related Art

Triboelectricity has been utilized in fundamental scientific research as a source of high electrostatic potential for over three centuries from the early electrostatic apparatus of Haukesbee (F. Haukesbee, *Physico-Mechanical experiments on various subjects* (London: 1709)) through to the eponymous generators of van der Graaf, yet there remains a notable absence of a first principles approach to the subject (M. Stoneham, Modelling Simul. Mater. Sci. Eng. 17, 084009 (2009)). Electrostatic generators store the integrated charge that is developed when two materials are rubbed together in frictional contact. The materials are selected to be furthest apart in the triboelectric series—an empirically derived list showing both the propensity of the materials to charge and the polarity of charge (P. E. Shaw, Proc. R. Soc. Lond. A 94, 16 (1917)). At the point of contact between the two materials, the frictional electrification may be of such magnitude that it may ionize the gas surrounding it, creating triboluminescence. The triboluminescence observed during peeling pressure sensitive adhesive (PSA) tape has long attracted scientific attention (E. N. Harvey, Science 89, 460 (1939)) and has an electrostatic origin. When the tape is peeled, charge densities $10^{12}$ e $cm^{-2}$ (where is e is the fundamental charge on the electron) are exposed on the surfaces of the freshly peeled region and subsequently discharge (C. G. Camara, J. V. Escobar, J. R. Hird and S. P. Putterman, Nature 455, 1089 (2008)). If the tape is peeled in vacuum ~10 mTorr, it has been found that the triboluminescence produced extends to X-ray energies (V. V. Karasev, N. A. Krotova and B. W. Deryagin, Dokl. Akad. Nauk. SSR 88 777 (1953)). More recently (Camara, et al., id.), it was found that there are two timescales for tribocharging during the peeling of tape in vacuo: the first, common to electrostatic generators and classic electrostatic experiments (W. R. Harper, *Contact and frictional electrification*, (Oxford University Press, London, 1967)), is the long timescale process which results in an average charge density of $10^{10}$ e $cm^{-2}$ being maintained on the surface of the tape and second, a nanosecond process with charge densities of $10^{12}$ e $cm^{-2}$. In addition, it was found that the X-ray discharge from peeling tape was sufficiently self-collimated at the peel line to resolve the inter-phlangeal spacing of a human digit. The emission of nanosecond X-ray pulses allowed an estimate of the emission region to be calculated. Subsequent research on peeling PSA tape with a width of 1.5 mm has confirmed that the process takes place at dimensions less than 300 μm (C. G. Camara, J. V. Escobar, J. R. Hird and S. P. Putterman, Appl. Phys. B 99, 613 (2010)).

Underpinning this recent work on triboelectricity is a resurgence of interest in how charge transfer occurs between different materials and particularly between polymers. Particularly intriguing is the report of like-polymers charging each other (M. M. Apodaca, P. J. Wesson, K. J. M. Bishop, M. A. Ratner and B. A. Grzybowski, Angew. Chem. Int. Ed. 49, 946 (2010)). More fundamentally, an open question is whether the transfer particle is an ion (L. McCathy and G. M. Whitesides, Angew. Chem. Int. Ed. 47, 2188 (2008)) or an electron (Harper, id.)—a matter that is still debated despite centuries of experimental research. Whether the charge carriers responsible for tribocharging are electrons or ions, what is clear is that very large charge densities are readily generated.

For the most effective charging to occur, intimate contact between the materials and cleanliness of the contacting surfaces is important (R. Budakian, K. Weninger, R. A. Hiller and S. P. Putterman, Nature 391, 266 (1998)). While the peeling geometry of PSA tapes is mathematically elegant (A. D. McEwan and G. I. Taylor, J. Fluid Mech. 26, 1 (1966)) and meets both criteria, a disadvantage of using these for a portable X-ray device not requiring a high voltage supply is, however, the significant out-gassing that occurs during peeling off-the-shelf tape in vacuo (E. Constable, J. Horvat and R. A. Lewis, Appl. Phys. Lett. 97, 131502 (2010)) as well as practical issues such as reliability, wear, etc. There thus remains a need for improved triboelectric x-ray sources and systems.

SUMMARY

An x-ray source according to an embodiment of the current invention includes an enclosing vessel, a first roller arranged at least partially within the enclosing vessel, a second roller arranged at least partially within the enclosing vessel and to be in rolling contact with the first roller, and a drive assembly operatively connected to at least one of the first and second rollers. The drive assembly causes the first and second rollers to rotate while in contact to bring portions of the first and second rollers into and out of contact within the enclosing vessel as the first and second rollers rotate. The first roller has a surface at least partially of a first triboelectric material and the second roller has a surface at least partially of a second triboelectric material, the first triboelectric material having a negative triboelectric potential relative to the second triboelectric material. The enclosing vessel is structured to provide a controlled atmospheric environment, and the first triboelectric material, the second triboelectric material and the controlled atmospheric environment are selected such that rolling contact between the first and second rollers produces x-rays.

An x-ray imaging system according to an embodiment of the current invention includes an x-ray source, and an x-ray detector. The x-ray source includes an enclosing vessel, a first roller arranged at least partially within the enclosing vessel, a second roller arranged at least partially within the enclosing vessel and to be in rolling contact with the first roller, and a drive assembly operatively connected to at least one of the first and second rollers. The drive assembly causes the first and second rollers to rotate while in contact to bring portions of the first and second rollers into and out of contact within the enclosing vessel as the first and second rollers rotate. The first roller has a surface at least partially of a first triboelectric material and the second roller has a surface at least partially of a second triboelectric material, the first triboelectric material having a negative triboelectric potential relative to the second triboelectric material. The enclosing vessel is structured to provide a controlled atmospheric environment, and the first triboelectric material, the second triboelectric material and the controlled atmospheric environment are selected such that rolling contact between the first and second rollers produces x-rays.

BRIEF DESCRIPTION OF THE DRAWINGS

Further objectives and advantages will become apparent from a consideration of the description, drawings, and examples.

FIG. 2 Nature Supplementary is the integrated flux used to obtain previously published x-ray images by peeling 2 cm wide tape at 20 cm/s. FIG. 2 Nature is the integrated flux from peeling 2 cm tape at 3.6 cm/s. FIG. 3 APB is the flux obtained from peeling a 1.5 mm strip of tape at 3.6 cm/s. The diamonds represent data from peeling 2 cm wide scotch tape, showing that this system also scales linearly with rotation speed. The dots represent data from a lead roller in contact with tape backing (treated polyethylene). The inset shows averaged values for representative velocities.

FIG. 12A shows the object placed on the window over the source. FIG. 12B shows an x-ray image taken at 200 rpm and 30 sec exposure.

DETAILED DESCRIPTION

Some embodiments of the current invention are discussed in detail below. In describing embodiments, specific terminology is employed for the sake of clarity. However, the invention is not intended to be limited to the specific terminology so selected. A person skilled in the relevant art will recognize that other equivalent components can be employed and other methods developed without departing from the broad concepts of the current invention. All references cited anywhere in this specification, including the Background and Detailed Description sections, are incorporated by reference as if each had been individually incorporated.

Some embodiments of the current invention are directed to an apparatus and a method to generate collimated x-rays without the use of a high voltage power supply. An x-ray source according to an embodiment of the current invention does not require high voltage electronics and can be powered by any source of mechanical motion. We have demonstrated that simply bringing two materials into contacting motion can generate a flux of x-rays useful for x-ray imaging. The contact geometry can be used to provide collimation. We have demonstrated a line of x-ray emission which coupled to a line x-ray detector can provide a simple method to obtain x-ray images. Some embodiments of the current invention can provide ultra-portable x-ray sources that require no electricity grid. Previous work by the current inventors can be found in WO/2009/102784 MECHANOLUMINESCENT X-RAY GENERATOR, the entire content of which is incorporated herein by reference. (See, also, Nature v455 1089-1092 (2008) and Appl. Phys. v99 613-617 (2010), the entire contents of which are incorporated herein by reference.)

This x-ray source requires no high voltage power supply and can be driven by simple direct mechanical motion. The x-ray emission from contacting rotating rollers originates from a small region close to the vertex which spans the length of the contact. The result is a line of x-ray emission. This is a unique capability which distinguishes this source from all current technology.

Figure 1:
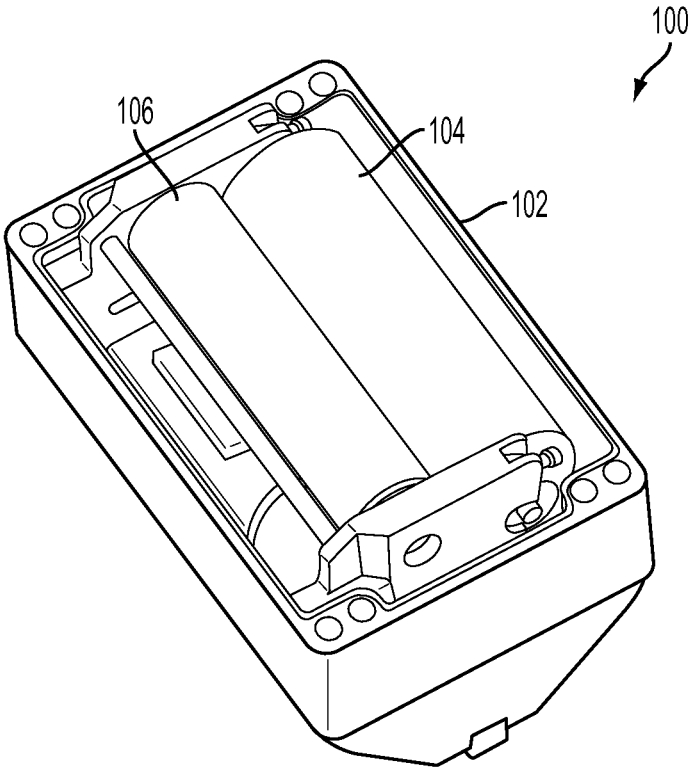
FIG. 1 is a schematic illustration of an X-ray source, with a portion of the enclosing vessel removed, according to an embodiment of the current invention.

Some embodiments of the current invention relate to systems and methods that provide contacting motion of different materials in a controlled environment as a source of x-rays which can be collimated and which can be narrow in time and energy. A simple embodiment of this invention is two rollers of different materials made to rotate by their contact friction under a partial vacuum as illustrated in FIG. 1. This arrangement can be used to generate a flux of x-rays useful for x-ray imaging. The x-ray emission can take place both continuously and in nanosecond bursts from a region close to the vertex which extends the length of the contact.

In addition, the effect of changing the force with which two or more rolling surfaces are brought into contact can have a large effect on x-ray production because the force of compression of the surfaces will change the charge transfer. Also partial rotation and changing rotations can be useful according to some aspects of the current invention. For example, two surfaces which roll a few degrees in the clockwise direction can then reverse so that they roll in the counterclockwise direction and then oscillate in this manner according to an embodiment of the current invention. The general concepts of this invention are not limited to only cylindrical rollers in contact with other cylindrical rollers. Surfaces with shapes other than cylindrical can be used according to some embodiments of the current invention. In some embodiments, one of the surfaces can be planar, for example, and the other surface can be a roller going back and forth on the planar surface. The broad concepts of the current invention are not limited to these particular examples.

Figure 2A:
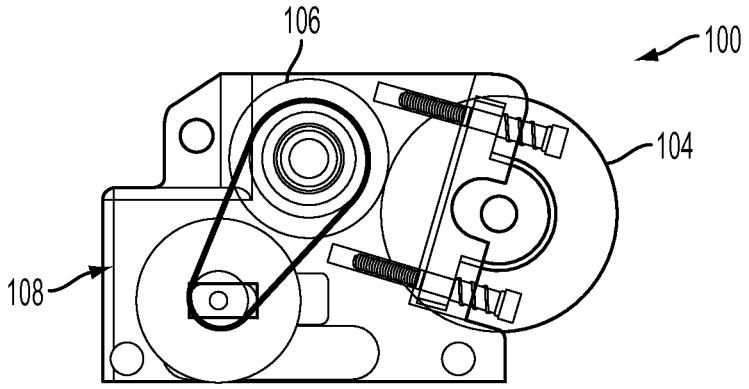
FIG. 2A is a schematic illustration of side view of an X-ray source, with the enclosing vessel removed, according to an embodiment of the current invention.
Figure 4:
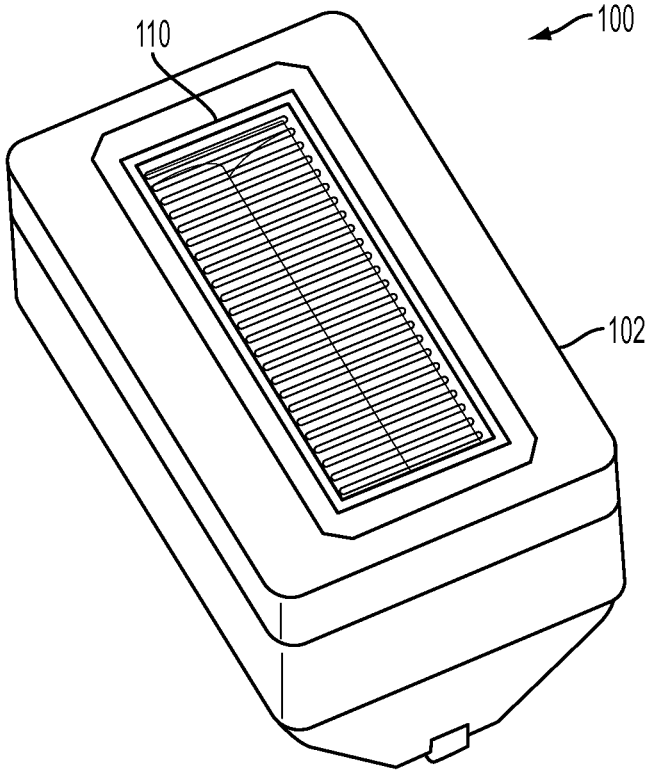
FIG. 4 is a schematic illustration of an X-ray source according to an embodiment of the current invention.
Figure 5:
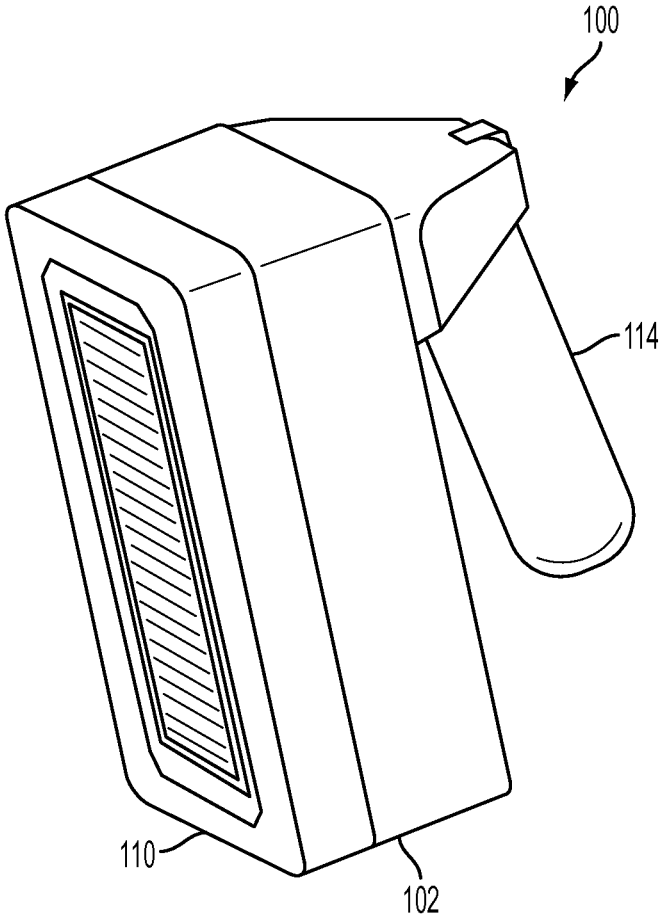
FIG. 5 is a schematic illustration of an X-ray source according to an embodiment of the current invention.
Figure 6:
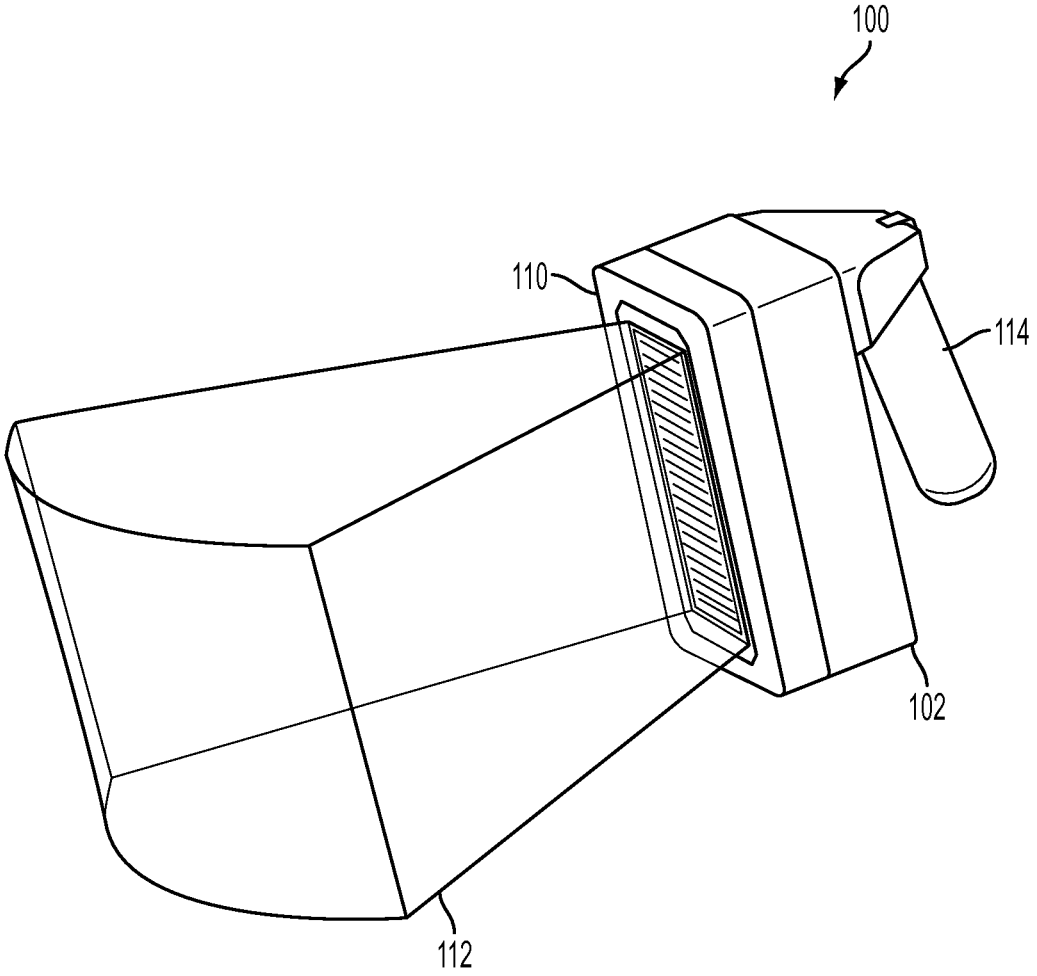
FIG. 6 is a schematic illustration of an X-ray source according to an embodiment of the current invention.

FIG. 1 is a schematic illustration of an x-ray source 100 according to an embodiment of the current invention. The x-ray source 100 in FIG. 1 is shown in a partially assembled view to allow internal structure to be viewed. The x-ray source 100 includes an enclosing vessel 102, the lower half of which is shown in FIG. 1; a first roller 104 arranged at least partially within the enclosing vessel 102; a second roller 106 arranged at least partially within the enclosing vessel 102 and to be in rolling contact with the first roller 104; and a drive assembly 108 (FIG. 2A) operatively connected to at least one of the first roller 104 and second roller 106. The drive assembly 108 causes the first and second rollers 104, 106 to rotate while in contact to bring portions of the first and second rollers 104, 106 into and out of contact within the enclosing vessel 102 as the first and second rollers 104, 106 rotate. The first roller 104 has a surface at least partially of a first triboelectric material and the second roller 106 has a surface at least partially of a second triboelectric material. As is shown schematically in FIG. 3, the first triboelectric material has a negative triboelectric potential relative to the second triboelectric material. However, the general concepts of the current invention are not limited to the embodiments shown in FIGS. 1-3. The order of the materials can be reversed in other embodiments. The enclosing vessel 102 is structured to provide a controlled atmospheric environment (see, also, FIGS. 4-6). The first triboelectric material, the second triboelectric material and the controlled atmospheric environment are selected such that rolling contact between the first and second rollers 104, 106 produces x-rays.

The enclosing vessel 102 of the x-ray source 100 has an x-ray window 110 that is substantially transparent to x-rays 112 relative to remaining portions of the enclosing vessel 102. In other words, the enclosing vessel 102 provides shielding to substantially block x-rays from exiting the vessel 102 except through the window 110. The enclosing vessel, including the window 110, maintains a vacuum such that a gas pressure within the vessel 102 is less than the atmospheric pressure immediately outside the vessel 102. In an embodiment of the current invention, the enclosing vessel 102 is constructed to maintain a vacuum less than $10^{-1}$ torr. In an embodiment of the current invention, the enclosing vessel 102 is constructed to maintain a vacuum greater than $10^{-9}$ torr and less than $10^{-3}$ torr.

In another embodiment, at least one of the first roller 104 and the second roller 106 has at least two surface regions of different triboelectric materials such that at least two different x-ray spectra are produced during rolling contact between the first and second rollers 104, 106. As one should readily recognize, various embodiments of the current invention can include rollers coated with one, two, three or more types of triboelectric materials, which could also be coated is selected spatially patterns, to alter the type of x-ray spectrum produced by the x-ray source 100. In addition, materials that include one or more selected atomic elements that have desired excited states to enhance narrow band x-ray emission can also be included. (See also, International Patent Application number PCT/US2012/028581, Mar. 9, 2012 by the same assignee as the assignee of the current application, the entire content of which is incorporated herein by reference.)

In an embodiment of the current invention, the drive assembly 108 can include an electric motor. In some embodiments, the x-ray source 100 can further include an electrical power storage component that can include at least one of a battery, a capacitor, or a super capacitor. For example, batteries could be located in the handle 114. In some embodiments, the x-ray source 100 can further include a photovoltaic element. In further embodiments, the x-ray source 100 can also include a hand-operated charger. In some embodiments, the drive assembly can include a hand-operated mechanism (not shown in the drawings). This can include a hand crank, for example. Such a hand-operated mechanism can be either in place of, or in addition to, an electric motor.

Other embodiments of the current invention can include three, four or more rollers. For example, three, four or more rollers can be arranged side-by-side such that driving at least one roller can cause the remaining rollers to rotate by frictional contact. These can be thought of as rollers in series. Alternatively, or in addition, separate pairs or series arrangements of rollers can be provided by other embodiments of the current invention. For example, one pair of rollers can be arranged next to another pair of rollers in which each pair of rollers is driven independently of the other pair. These can be thought of as rollers in parallel. Each roller that is in contact with an adjacent roller can be constructed to produce x-rays at the intersection. Therefore, in one embodiment in which there is one pair of rollers, the x-ray source 100 provides a line source of x-rays. In the case in which there are more than two rollers, the x-ray source can provide a multiline source of x-rays. In some embodiments, a plurality of rollers can provide effectively a planar x-ray source.

X-ray pulses can be generated when the pressure is lower than $10^{-3}$ torr and the contacting materials are a metal vs. a polymer insulator. Also, a contact area of about 1 mm has been found suitable for producing x-ray pulses. The x-ray pulses can be on the order of tens of nano seconds, for example.

Figure 6A:
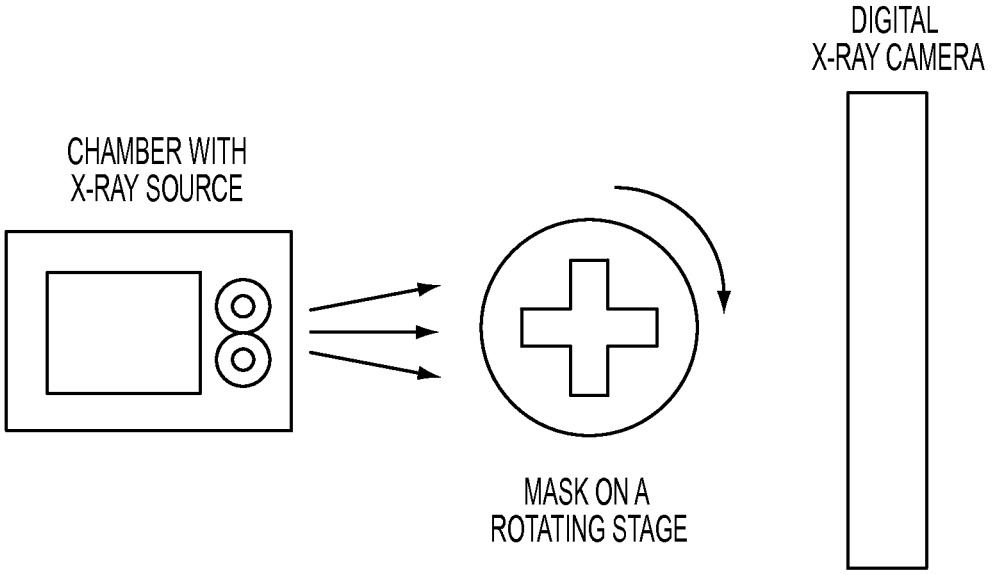
FIG. 6A is a schematic illustration of an X-ray system according to an embodiment of the current invention.

Since the x-ray source 100 can provide a line, or multiline, x-ray source, an x-ray imaging system can provide a linear detector selected to correspond to the line source according to some embodiments of the current invention (see, FIG. 6A).

The following provides some examples to help further explain to concepts of the current invention. The broad concepts of the current invention are not limited to the particular examples.

EXAMPLES

Figure 7:
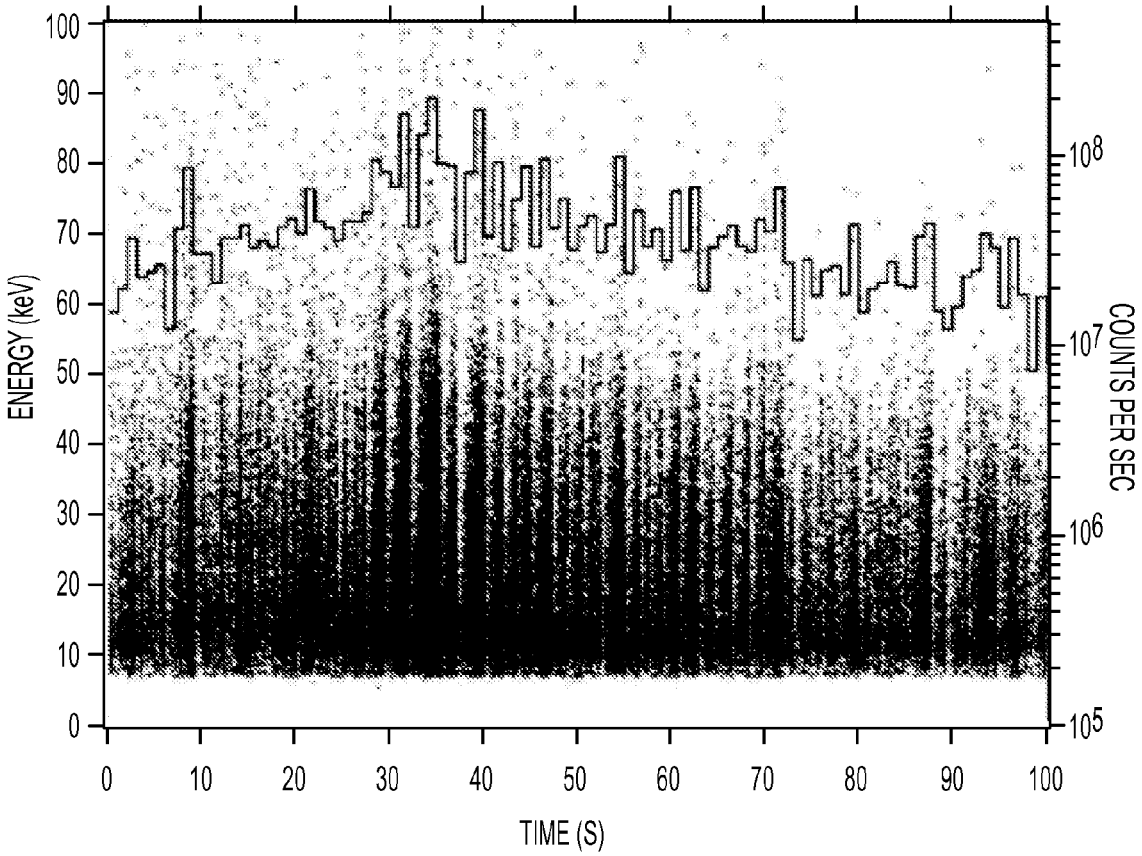
FIG. 7 shows an example of X-ray emission from 2 cm wide rollers brought into contact by tension springs and made to rotate at 300 rpm at an ambient pressure of $1\times10^{-3}$ Torr. One roller was covered with lead tape and the other with a layer of tape (treated polyethylene).

In an example, two rollers of different materials were selected to exchange and hold charge after contact. They can be pressed into contact by an external force, such as, but not limited to springs. A source of mechanical motion such as but not limited to an electric motor brings the surfaces into relative motion. A particular example of this embodiment is given by a roller with a metallic surface in contact with a polymer roller. The x-ray emission from such a system rotating in a vessel held at a pressure of $1\times10^{-3}$ Torr of air is provided in FIG. 7.

The x-ray flux from contacting rotating rollers can be controlled by the rotation speed (FIG. 8) and it is proportional to the rotation speed up to a tangential velocity of 80 cm/s (see, Inset, FIG. 8) according to an embodiment of the current invention. This speed corresponds to a rotation speed of 200 rpm. In general, the x-ray flux scales with the area of material that is brought into and out of contact per second. For comparison to our previous work, FIG. 8 also includes a compilation of data from Nature 455, Oct. 23, 2008 and Applied Physics B 99, 2010.

Figure 2B:
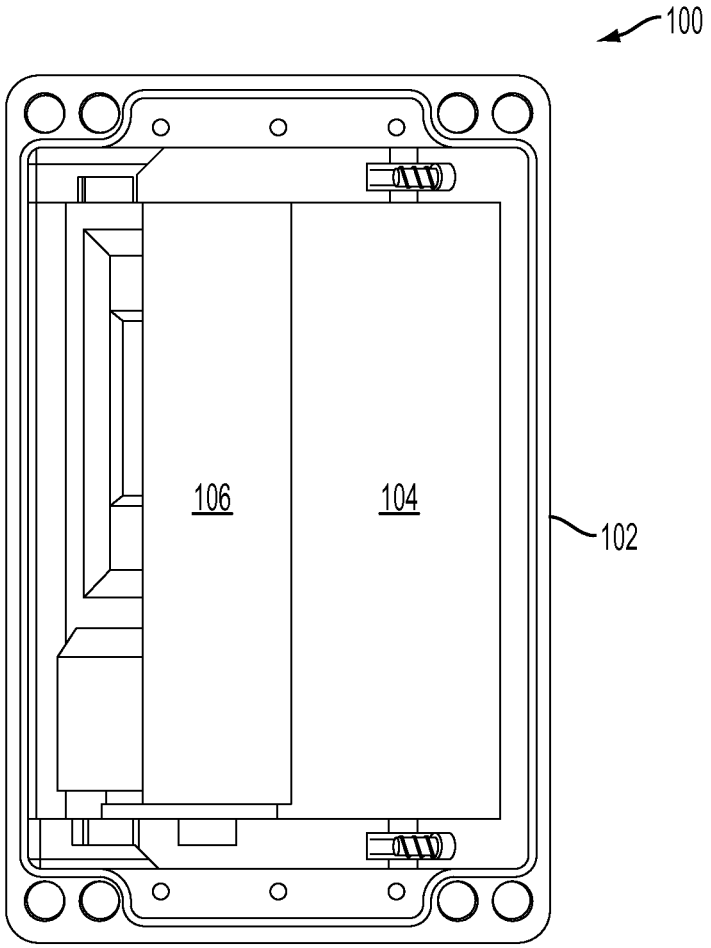
FIG. 2B is a schematic illustration of top view of an X-ray source, with a portion of the enclosing vessel removed, according to an embodiment of the current invention.
Figure 3:
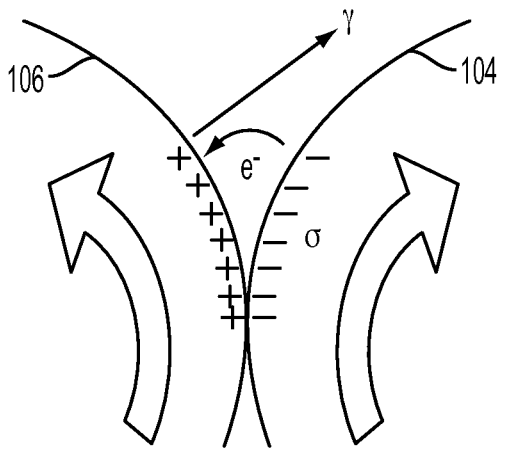
FIG. 3 is a schematic illustration of a close-up view of a contact region between two rollers to help explain some concepts of the current invention.
Figure 8:
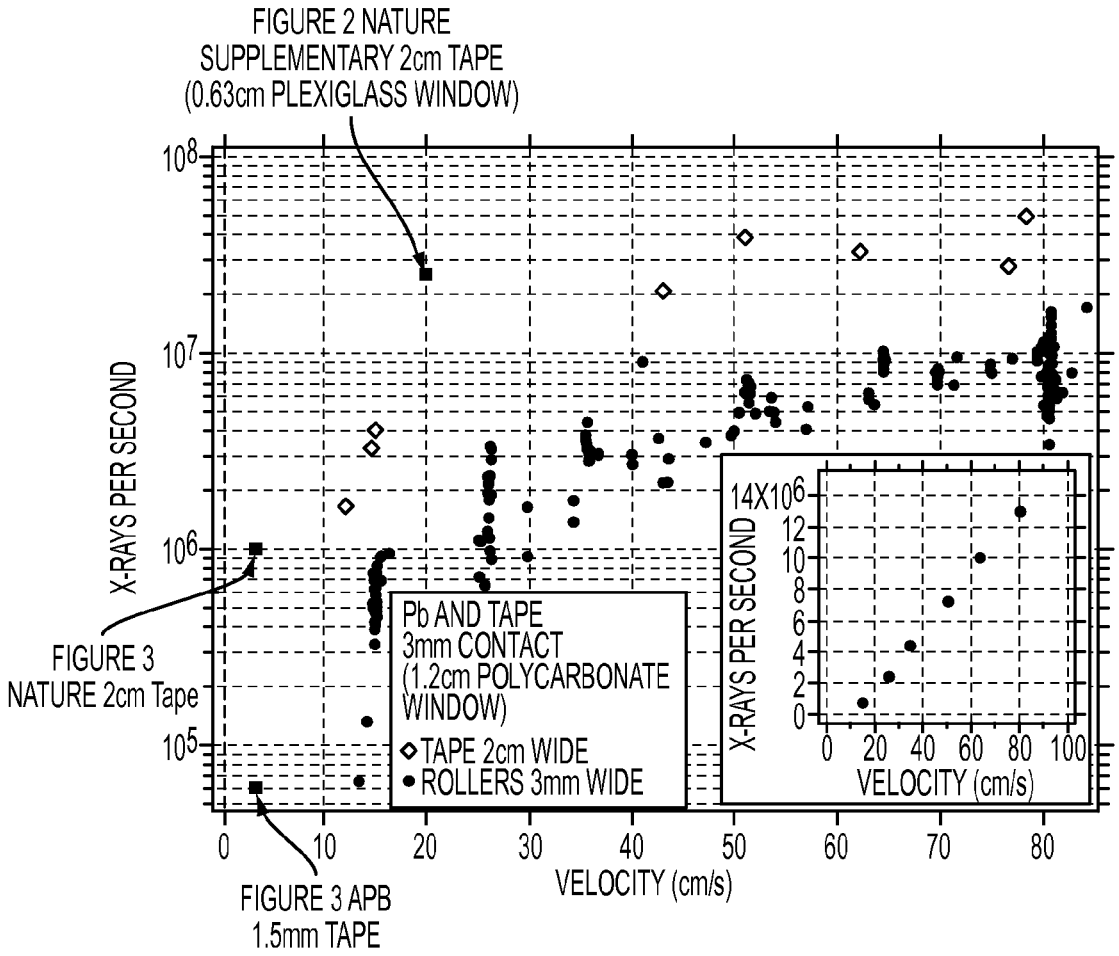
FIG. 8 shows an example of X-ray flux as a function of rotation speed for different systems. Black squares represent the summary of our previous published results for peeling scotch tape.

FIG. 8 shows the x-ray flux as a function of rotation speed for different systems. Black squares represent the summary of our previously published results for peeling scotch tape. Figure of Nature Supplementary is the integrated flux used to obtain previously published x-ray images by peeling 2 cm wide tape at 20 cm/s. FIG. 2 of Nature is the integrated flux from peeling 2 cm tape at 3.6 cm/s. FIG. 3 APB is the flux obtained from peeling a 1.5 mm strip of tape at 3.6 cm/s. The squares represent data from peeling 2 cm wide scotch tape, showing that this system also scales linearly with rotation speed. The red dots represent data from a lead roller in contact with tape backing (treated polyethylene). The inset shows averaged values for representative velocities.

Figure 9:
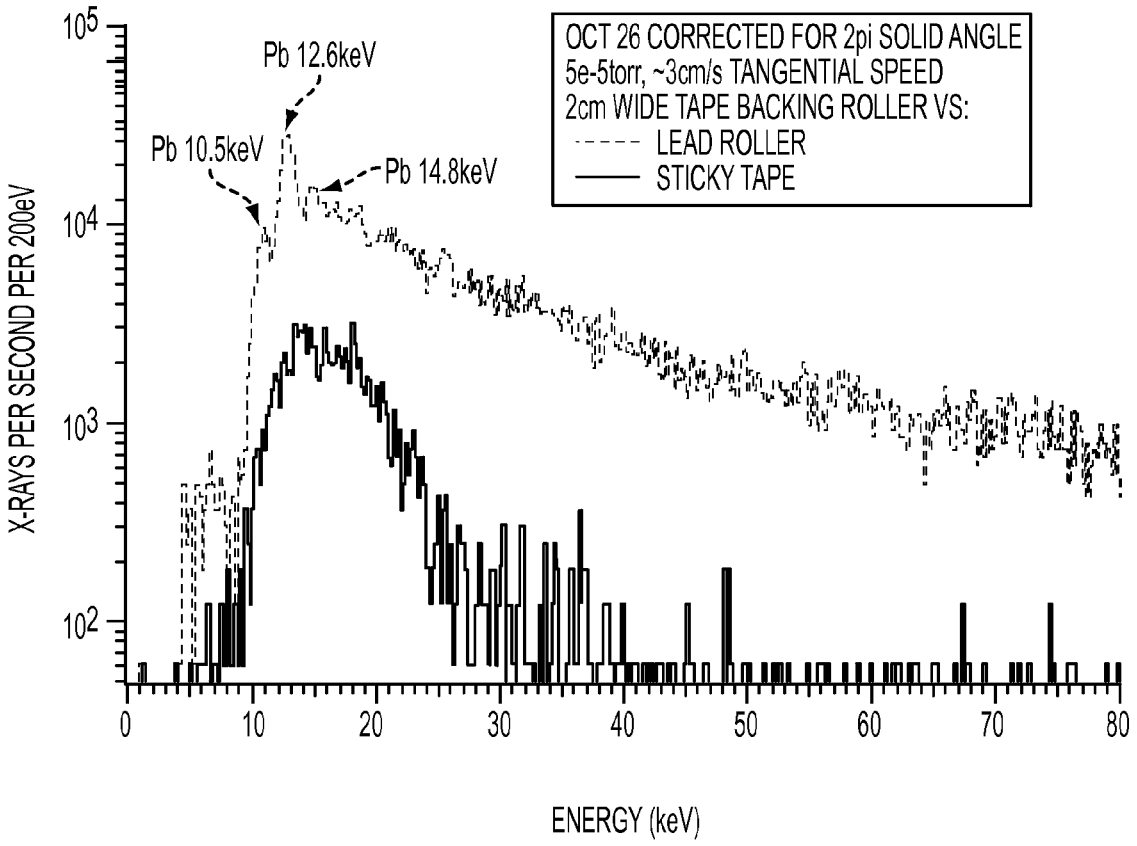
FIG. 9 shows an example of an X-ray spectrum for 2 cm wide rollers in contact at an ambient pressure of $5\times10^{-5}$ Torr and a tangential velocity of 3 cm/s. The top trace is the spectrum from a lead roller in contact with tape backing (treated polyethylene). The lower trace is from a roller of sticky-side-out scotch tape against tape backing

The x-ray spectrum of lead rotating against the backing of a roll of tape (treated polyethylene) shows the characteristic lead L-lines in FIG. 9, upper curve. This is a clear indication that the lead charges positively relative to the tape backing and acts as the electron target. Under the same experimental conditions we have measured the x-ray emission from a roll of tape backing against a roll of sticky-side-out scotch tape (FIG. 9 lower curve). The difference in x-ray flux from these two systems demonstrates a method to control the efficiency with which high energy electrons are converted into x-rays by changing the atomic weight (Z) of the target material. These results also indicate that one roller composed of different materials can be used to control the emission as a function of place of contact.

Figure 10:
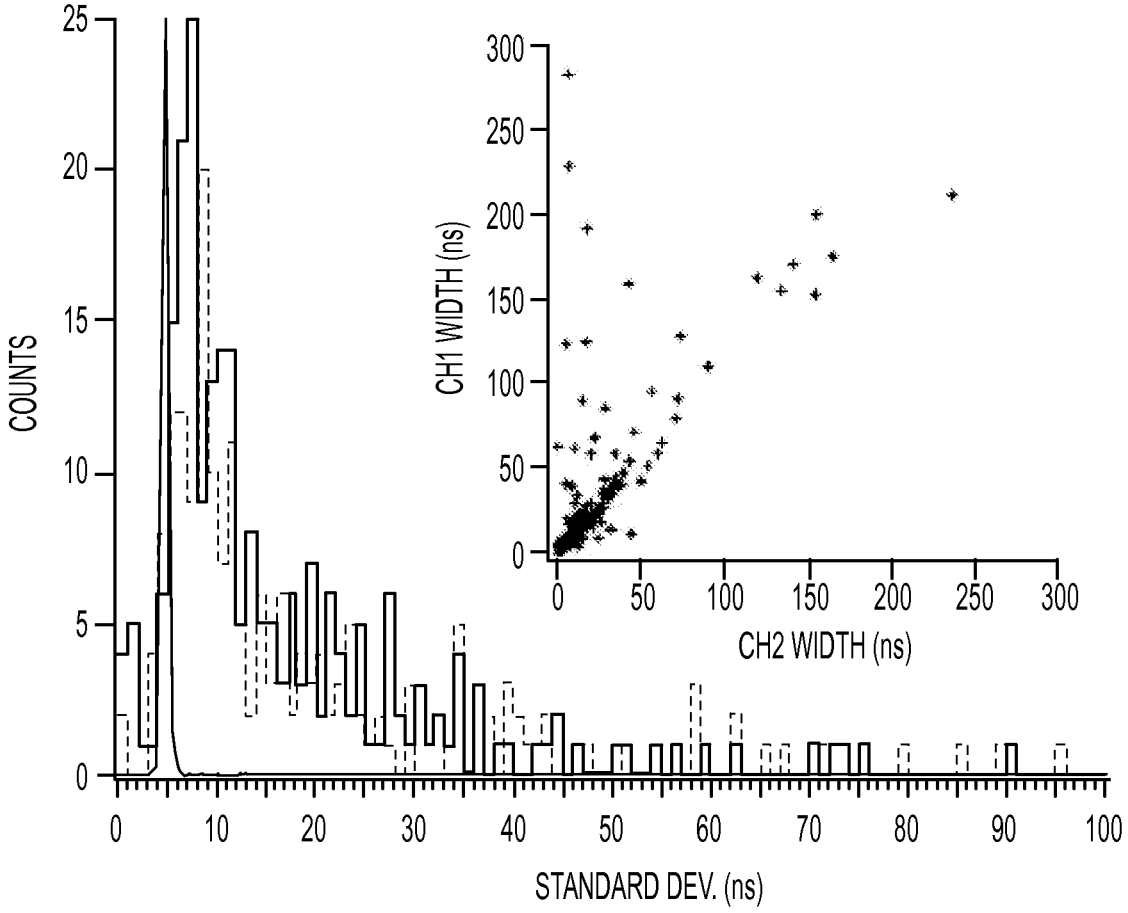
FIG. 10 shows an example of width of x-ray bursts from a 3 mm wide roll of lead rotating against a polyethylene roller at 3 cm/s. Two liquid scintillators coupled to 5' PMTs were used to detect x-ray pulses with energy above 50 keV, shown in histograms. The PMT signals were recorded and then fit to a Gaussian to obtain their width. The inset shows the correlation between the two detectors, indicating that x-ray pulses were indeed measured. The narrow trace to the right is a histogram of the widths from cosmic rays, showing that the characteristic signals have a width of 5 ns.

The x-ray emission from contacting motion can result in bursts of x-rays (FIG. 10). These measurements indicate that the x-ray pulses from a lead roller against a polyethylene roller are 10-20 ns long. This in turn implies a discharge distance of about 1 mm and a charge density of about $1\times10^{11}$ $e^-/cm^2$ [Nature 455, Oct. 23, 2008]. These results indicate that this x-ray source is collimated in space and narrow in time.

Figure 11:
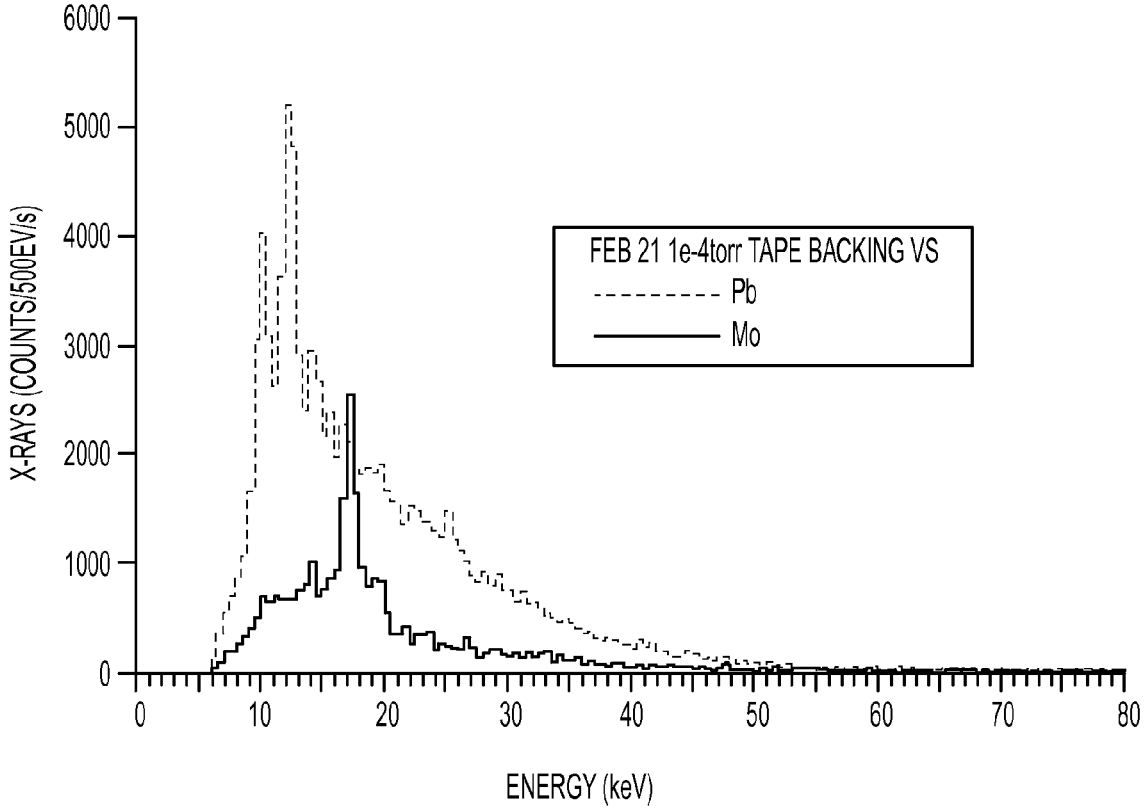
FIG. 11 shows an X-ray spectrum for 2 cm wide rollers in contact at an ambient pressure of $1\times10^{-4}$ Torr and a tangential velocity of 3 cm/s. The upper trace is the spectrum from a lead roller in contact with tape backing (treated polyethylene). The lower trace is from a roller of Molybdenum against tape backing. The characteristic L lines from Lead and the K lines from Molybdenum can be clearly identified.
Figure 12A:
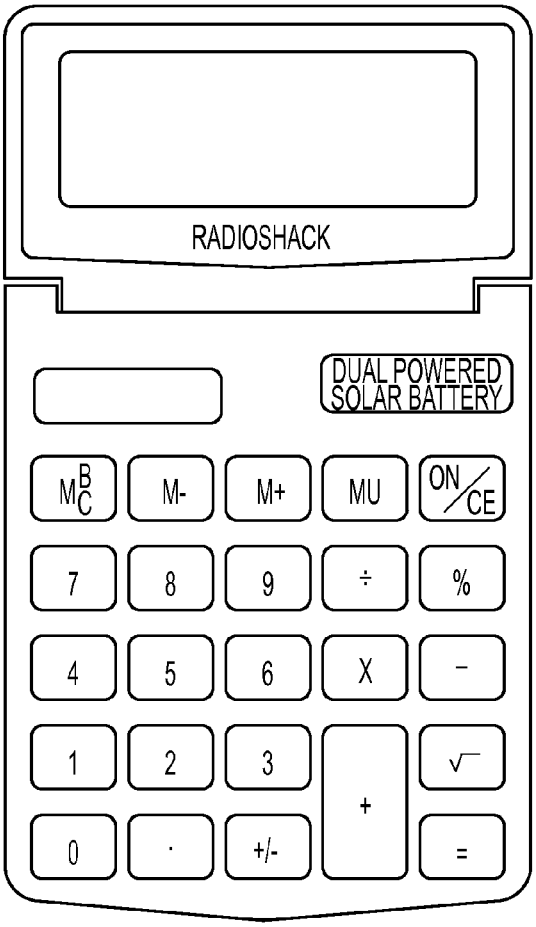
FIGS. 12A and 12B provide an example of an X-ray image taken with contacting rotating rollers, 1 cm wide, Pb vs polymer.
Figure 12B:
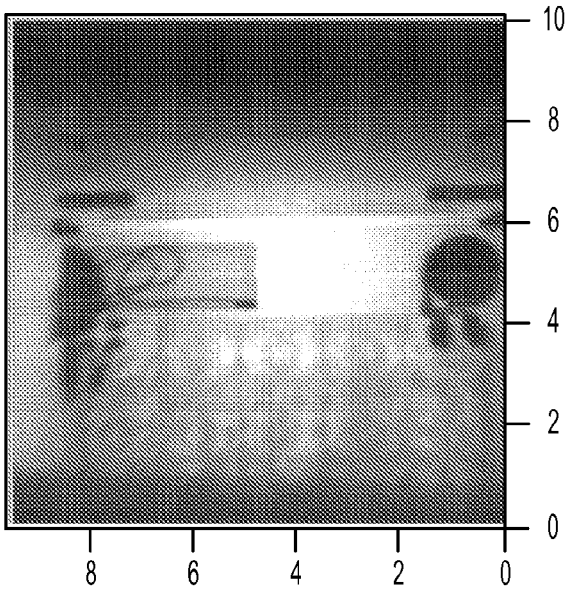

The spectrum of x-rays emitted from contacting motion can be controlled by the composition of the materials. FIG. 11 shows the spectrum from a polymer roller against a lead roller compared to the spectrum from the same polymer against a molybdenum roller. The x-ray emission from the molybdenum roller is dominated by the characteristic K lines and shows a control of the x-ray energy spectrum. This spectral distribution is typical for current mammography systems. This source could be useful for contrast enhanced x-ray imaging. For example by using a roller with half of its surface covered with one material and the rest in another, resulting in an alternating x-ray spectrum of different energy synched to the rotation.

An x-ray source according to an embodiment of the current invention can also be used for phase contrast imaging by using the characteristic x-ray lines of a target material to narrow the energy spectrum as well as the small source size. Multiple parallel rollers can act as an array of vertical sources in place of a grid.

An x-ray source according to an embodiment of the current invention can also be used for x-ray tomography. In particular, an array of different sources can be used to take multiple x-ray images without having to move the source.

Examples of x-ray images taken with x-ray emission from contacting rollers are provided in FIGS. 12A-15.

Figure 13:
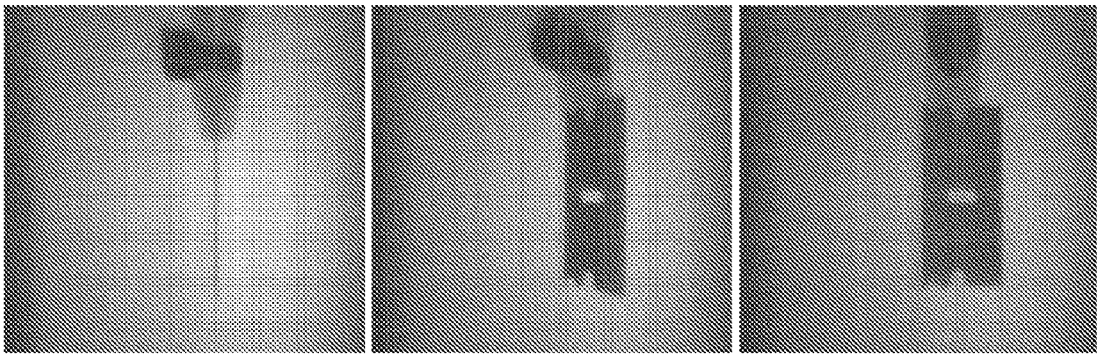
FIG. 13 shows examples of X-ray images of a stainless steel razor 250 micron thick at 0, 45 and 90 degrees according to an embodiment of the current invention, 2 cm from detector and 8 cm from vertex. At 0 degrees the razor is pointing directly into the vertex and perpendicular to the detector. Rollers are 1 cm wide rotating at 30 rpm and exposure is 30 s. Such images can be used for topographic reconstruction.
Figure 14:
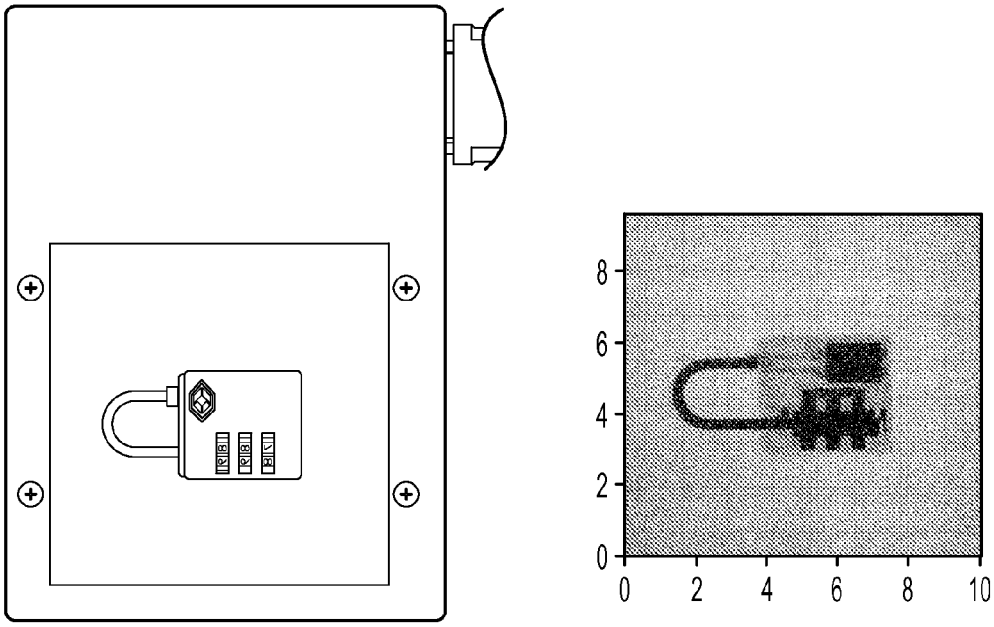
FIG. 14 shows an example of an X-ray image of a padlock and a picture of the object over a digital x-ray detector, RadIcon RadEye200. The detector has an active area of 10×10 cm and a pixel resolution of 100 μm. The image resolution is about ¼ mm.
Figure 15:
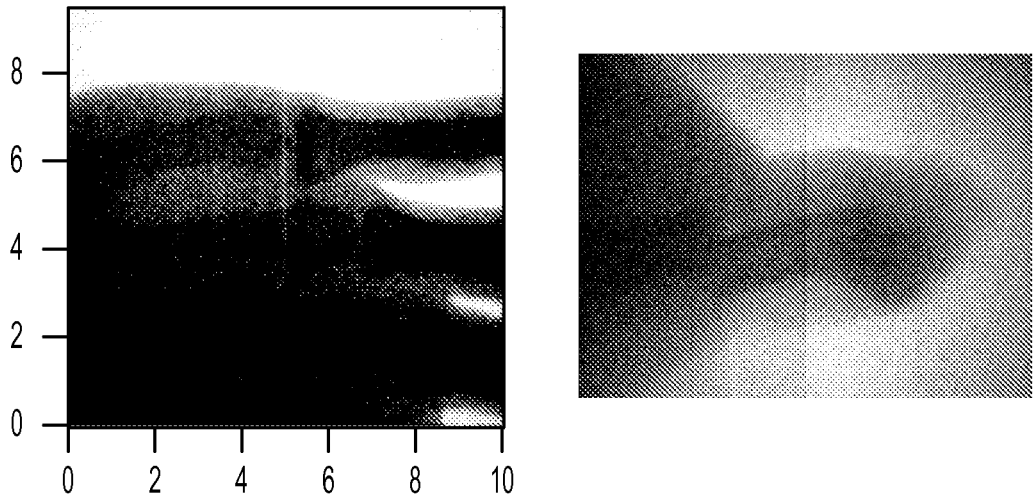
FIG. 15 shows examples of X-ray images of a hand and a broken chicken thigh according to an embodiment of the current invention.

An x-ray source according to an embodiment of the current invention can provide a portable, mechanically driven x-ray source that is useful for x-ray imaging without electricity. Combined with a linear CdTe x-ray detector, for example, it can be used to obtain energy resolved x-ray imaging. This invention can be used for tomographic reconstruction such as in digital breast thomosynthesis (FIG. 13).

An x-ray source according to an embodiment of the current invention can also be used for x-ray fluorescence.

The embodiments illustrated and discussed in this specification are intended only to teach those skilled in the art how to make and use the invention. In describing embodiments of the invention, specific terminology is employed for the sake of clarity. However, the invention is not intended to be limited to the specific terminology so selected. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

We claim:

1. An x-ray source, comprising:

an enclosing vessel;

a first roller arranged at least partially within said enclosing vessel;

a second roller arranged at least partially within said enclosing vessel and to be in rolling contact with said first roller; and a drive assembly operatively connected to at least one of said first and second rollers, wherein said drive assembly causes said first and second rollers to rotate while in contact to bring portions of said first and second rollers into and out of contact within said enclosing vessel as said first and second rollers rotate, wherein said first roller has a surface at least partially of a first triboelectric material and said second roller has a surface at least partially of a second triboelectric material, said first triboelectric material having a negative triboelectric potential relative to said second triboelectric material, wherein said enclosing vessel is structured to provide a controlled atmospheric environment, and wherein said first triboelectric material, said second triboelectric material and said controlled atmospheric environment are selected such that rolling contact between said first and second rollers produces x-rays.

2. An x-ray source according to claim 1, wherein said enclosing vessel has an x-ray window that is substantially transparent to x-rays relative to remaining portions of said enclosing vessel.

3. An x-ray source according to claim 1, wherein said enclosing vessel is constructed to maintain a vacuum less than $10^{-1}$ torr.

4. An x-ray source according to claim 1, wherein said enclosing vessel is constructed to maintain a vacuum greater than $10^{-9}$ torr and less than $10^{-3}$ torr.

5. An x-ray source according to claim 1, wherein at least one of said first roller and said second roller has at least two surface regions of different triboelectric materials such that at least two different x-ray spectra are produced during rolling contact between said first and second rollers.

6. An x-ray source according to claim 1, wherein said drive assembly comprises an electric motor.

7. An x-ray source according to claim 1, further comprising an electrical power storage component comprising at least one of a battery, a capacitor, or a super capacitor.

8. An x-ray source according to claim 7, further comprising a photovoltaic element.

9. An x-ray source according to claim 7, further comprising a hand-operated charger.

10. An x-ray source according to claim 1, wherein said drive assembly comprises a hand-operated mechanism.

11. An x-ray source according to claim 1, further comprising a third roller arranged at least partially within said enclosing vessel and to be in rolling contact with at least one of said first roller and said second roller, wherein said drive assembly causes said first, second and third rollers to rotate while in contact to bring portions of said at least one of said first and second rollers into and out of contact with said third roller within said enclosing vessel as said first, second and third rollers rotate, wherein said third roller has a surface at least partially of a third triboelectric material, said third triboelectric material having a negative triboelectric potential relative to at least one of said first and second triboelectric materials, and wherein said first triboelectric material, said second triboelectric material, said third triboelectric material and said controlled atmospheric environment are selected such that rolling contact between said first, second and third rollers produces x-rays along at least two roller contacts substantially simultaneously.

12. An x-ray source according to claim 1, further comprising:

a third roller arranged at least partially within said enclosing vessel;

a fourth roller arranged at least partially within said enclosing vessel and to be in rolling contact with said third roller, wherein said drive assembly is operatively connected to at least one of said third and fourth rollers, wherein said drive assembly causes said third and fourth rollers to rotate while in contact to bring portions of said third and fourth rollers into and out of contact within said enclosing vessel as said third and fourth rollers rotate, wherein said third roller has a surface at least partially of a third triboelectric material and said fourth roller has a surface at least partially of a fourth triboelectric material, said third triboelectric material having a negative triboelectric potential relative to said fourth triboelectric material, wherein said enclosing vessel is structured to provide a controlled atmospheric environment, and wherein said third triboelectric material, said fourth triboelectric material and said controlled atmospheric environment are selected such that rolling contact between said third and fourth rollers produces x-rays.

13. An x-ray source according to claim 1, further comprising a plurality of pairs of rollers arranged at least partially within said enclosing vessel and operatively connected to said drive assembly, wherein each roller of said plurality of pairs of rollers has at least a portion of a surface of a corresponding triboelectric material selected such that rolling contact between each of said plurality of pairs of rollers produces x-rays.

14. An x-ray source according to claim 1, wherein at least one of said first and second triboelectric materials comprises an atomic element in its composition that has an excited quantum energy state that can be excited by electrons traveling from one of said first and second rollers to the other of said first and second rollers, wherein said atomic element emits x-rays having an energy within at least one narrow energy band upon transition from said excited state into a lower energy state such that said x-ray source produces a narrow energy band of x-rays.

15. An x-ray imaging system, comprising:

an x-ray source; and an x-ray detector, wherein said x-ray source comprises:

an enclosing vessel;

a first roller arranged at least partially within said enclosing vessel;

a second roller arranged at least partially within said enclosing vessel and to be in rolling contact with said first roller; and a drive assembly operatively connected to at least one of said first and second rollers, wherein said drive assembly causes said first and second rollers to rotate while in contact to bring portions of said first and second rollers into and out of contact along a substantially linear region of contact within said enclosing vessel as said first and second rollers rotate, wherein said first roller has a surface at least partially of a first triboelectric material and said second roller has a surface at least partially of a second triboelectric material, said first triboelectric material having a negative triboelectric potential relative to said second triboelectric material, wherein said enclosing vessel is structured to provide a controlled atmospheric environment, wherein said first triboelectric material, said second triboelectric material and said controlled atmospheric environment are selected such that rolling contact between said first and second rollers produces x-rays along said substantially linear region of contact, and said x-ray detector comprises a linear detector constructed and arranged to detect x-rays from said x-ray source.

16. An x-ray imaging system according to claim 15, wherein said enclosing vessel has an x-ray window that is substantially transparent to x-rays relative to remaining portions of said enclosing vessel.

17. An x-ray imaging system according to claim 15, wherein said enclosing vessel is constructed to maintain a vacuum less than $10^{-1}$ torr.

18. An x-ray imaging system according to claim 15, wherein said enclosing vessel is constructed to maintain a vacuum greater than $10^{-9}$ torr and less than $10^{-3}$ torr.

19. An x-ray imaging system according to claim 15, wherein at least one of said first roller and said second roller has at least two surface regions of different triboelectric materials such that at least two different x-ray spectra are produced during rolling contact between said first and second rollers.

20. An x-ray imaging system according to claim 15, wherein said drive assembly comprises an electric motor.

21. An x-ray imaging system according to claim 15, further comprising an electrical power storage component comprising at least one of a battery, a capacitor, or a super capacitor.

22. An x-ray imaging system according to claim 21, further comprising a photovoltaic element.

23. An x-ray imaging system according to claim 21, further comprising a hand-operated charger.

24. An x-ray imaging system according to claim 15, wherein said drive assembly comprises a hand-operated mechanism.

25. An x-ray imaging system according to claim 15, further comprising a third roller arranged at least partially within said enclosing vessel and to be in rolling contact with at least one of said first roller and said second roller, wherein said drive assembly causes said first, second and third rollers to rotate while in contact to bring portions of said at least one of said first and second rollers into and out of contact with said third roller within said enclosing vessel as said first, second and third rollers rotate, wherein said third roller has a surface at least partially of a third triboelectric material, said third triboelectric material having a negative triboelectric potential relative to at least one of said first and second triboelectric materials, and wherein said first triboelectric material, said second triboelectric material, said third triboelectric material and said controlled atmospheric environment are selected such that rolling contact between said first, second and third rollers produces x-rays along at least two roller contacts substantially simultaneously.

26. An x-ray imaging system according to claim 15, further comprising:

a third roller arranged at least partially within said enclosing vessel;

a fourth roller arranged at least partially within said enclosing vessel and to be in rolling contact with said third roller, wherein said drive assembly is operatively connected to at least one of said third and fourth rollers, wherein said drive assembly causes said third and fourth rollers to rotate while in contact to bring portions of said third and fourth rollers into and out of contact within said enclosing vessel as said third and fourth rollers rotate, wherein said third roller has a surface at least partially of a third triboelectric material and said fourth roller has a surface at least partially of a fourth triboelectric material, said third triboelectric material having a negative triboelectric potential relative to said fourth triboelectric material, wherein said enclosing vessel is structured to provide a controlled atmospheric environment, and wherein said third triboelectric material, said fourth triboelectric material and said controlled atmospheric environment are selected such that rolling contact between said third and fourth rollers produces x-rays.

27. An x-ray imaging system according to claim 15, further comprising a plurality of pairs of rollers arranged at least partially within said enclosing vessel and operatively connected to said drive assembly, wherein each roller of said plurality of pairs of rollers has at least a portion of a surface of a corresponding triboelectric material selected such that rolling contact between each of said plurality of pairs of rollers produces x-rays.

28. An x-ray imaging system according to claim 15, wherein at least one of said first and second triboelectric materials comprises an atomic element in its composition that has an excited quantum energy state that can be excited by electrons traveling from one of said first and second rollers to the other of said first and second rollers, wherein said atomic element emits x-rays having an energy within at least one narrow energy band upon transition from said excited state into a lower energy state such that said x-ray source produces a narrow energy band of x-rays.

* * * * *